US005613675A

United States Patent [19]

Krüger et al.

[11] Patent Number: 5,613,675

[45] Date of Patent: Mar. 25, 1997

[54] METHOD AND DEVICE FOR CONVEYING SHEETS IN A FEEDER REGION OF A SHEET-PROCESSING MACHINE

[75] Inventors: Michael Krüger, Edingen-Neckarhausen; Götz Ruder, Heidelberg; Bernhard Wagensommer, Heidelberg; Detlef Gihr, Heidelberg, all of Germany

[73] Assignee: Heidelberger Druckmaschinen, Heidelberg, Germany

[21] Appl. No.: 379,719

[22] Filed: Jan. 27, 1995

[30] Foreign Application Priority Data

Jan. 27, 1994 [DE] Germany ..... 44 02 339.1
Dec. 15, 1994 [DE] Germany ..... 44 44 755.8

[51] Int. Cl.[6] ..... B65H 5/34

[52] U.S. Cl. ..... 271/270; 271/265.01

[58] Field of Search ..... 271/227, 229, 271/265.01, 270, 69, 202

[56] References Cited

U.S. PATENT DOCUMENTS

| | | | |
|---|---|---|---|
| 4,458,893 | 7/1984 | Ruh . | |
| 4,573,673 | 3/1986 | Haug | 271/270 |
| 4,863,154 | 9/1989 | Hirakawa et al. | 271/270 |
| 5,022,644 | 6/1991 | Burge | 271/265.01 |
| 5,037,365 | 8/1991 | Breton | 271/270 |
| 5,090,676 | 2/1992 | Matsuno et al. | 271/270 |
| 5,096,183 | 3/1992 | Hauck et al. . | |
| 5,119,146 | 6/1992 | Nobumori et al. | 271/270 |
| 5,213,036 | 5/1993 | Tokuno et al. . | |
| 5,482,265 | 1/1996 | Nakazato et al. | 271/265.01 |

FOREIGN PATENT DOCUMENTS

| | | | |
|---|---|---|---|
| 0313868 | 3/1989 | European Pat. Off. | 271/270 |
| 3138540 | 4/1983 | Germany . | |
| 3544359 | 5/1987 | Germany . | |
| 4001120 | 7/1991 | Germany . | |
| 4140051 | 6/1993 | Germany . | |
| 61-83924 | 6/1986 | Japan . | |
| 3295651 | 12/1991 | Japan . | |

*Primary Examiner*—Karen B. Merritt
*Assistant Examiner*—Douglas Hess
*Attorney, Agent, or Firm*—Herbert L. Lerner; Laurence A. Greenberg

[57] ABSTRACT

Device for conveying single sheets or a shingled sheet stream in a feeder region of a sheet-processing machine of a conveyor table equipped with at least one endless conveyor belt, and at least two rotatably supported deflection rollers over which the conveyor belt is guided, the conveyor belt being disposed so as to convey the sheets in a region between a sheet pile and front stops, wherefrom the sheets are transferable to a further processing location of the sheet-processing machine, includes a motor for driving the conveyor belt uncoupled from the sheet-processing machine, and a computer and control device for triggering the motor with a predetermined velocity profile exhibiting a velocity change as a function of an angular position of the sheet-processing machine; and method of operating the sheet-conveying device.

12 Claims, 4 Drawing Sheets

$v_D$
$v_{max2}$
$v_{max1}$
$v_{min}$
15
20
0°
180°
360°

METHOD AND DEVICE FOR CONVEYING SHEETS IN A FEEDER REGION OF A SHEET-PROCESSING MACHINE

BACKGROUND OF THE INVENTION

Field of the Invention

The invention relates to a method and device for conveying single sheets or for conveying a shingled sheet stream in a feeder region of a sheet-processing machine by means of a conveyor table which is equipped with at least one endless conveyor belt, guided over at least two rotatably supported deflection rollers, the conveyor belt conveying the sheets in a region between a sheet pile and front stops, wherefrom the sheets are transferred to the sheet-processing machine.

The sheets are lifted from a sheet pile by a suction strip or a suction head and transported individually or in a shingled manner across a conveyor table into the sheet-processing machine. In the vicinity of the conveyor table, the sheets are aligned so that they are taken over in-register by the sheet-processing machine. Alignment of the leading edges of the sheets occurs at the front lays of the conveyor table.

Heretofore, the feeding of sheets to the sheet-processing machine took place in accordance with the operating cycle of the machine; it was heretofore customary to couple the conveyor belt of the conveyor table to the main drive of the sheet-processing machines. From the published Japanese Patent Document JP-PO 3-295651, it has become known heretofore to drive the suction conveyor belt via a separate motor. In particular, the leading edge of a sheet is ascertained by a leading-edge sensor and, thereafter, a control device adjusts the velocity of the motor so that mechanical errors, which occur when suction is applied to the sheets, are corrected, and so that the sheet transport is thus optimally adjusted to the processing velocity of the sheet-processing machine.

From Japanese Utility Model Sho 61-83924, a delay device for sheet-fed printing presses has become known heretofore. In this case too, the main drive of the printing press is used to drive the conveyor belts of the conveyor table, but superimposed on this drive, however, is a cyclical motion of the conveyor belts for conveying the sheets, which operate in accordance with the operating cycle of the sheet-processing machine. By using a gear transmission with a plurality of eccentric gear wheels, the velocity of the conveyor belt is sinusoidally modulated in accordance with the machine operating cycle.

The gear transmission coupled to the main drive and having eccentric gear wheels has several disadvantages. First, the construction thereof dictates a fixed velocity profile. The velocity profile also exhibits only one maximum and one minimum, and the maximum and minimum can be reached at precisely one point. Furthermore, in the region of the feeder, a suitably ample amount of construction space for the gear transmission must be created. Last but not least, the individual parts of a mechanical transmission are subjected to major wear.

SUMMARY OF THE INVENTION

It is accordingly an object of the invention to provide an optimized method and a device for conveying sheets in the feeder region of a sheet-processing machine so that a sheet is transported in-register into the sheet-processing machine.

With the foregoing and other objects in view, there is provided, in accordance with the invention, a device for conveying single sheets or a shingled sheet stream in a feeder region of a sheet-processing machine by means of a conveyor table equipped with at least one endless conveyor belt, and at least two rotatably supported deflection rollers over which the conveyor belt is guided, the conveyor belt being disposed so as to convey the sheets in a region between a sheet pile and front stops, wherefrom the sheets are transferable to a further processing location of the sheet-processing machine, comprising a motor for driving the conveyor belt uncoupled from the sheet-processing machine, and a computer and control device for triggering the motor with a predetermined velocity profile exhibiting a velocity change as a function of an angular position of the sheet-processing machine.

In accordance with another feature of the invention, the motor is assigned to one of the deflection rollers.

In accordance with a further feature of the invention, the sheet-processing machine includes a cylinder having a shaft, a rotary angle encoder mounted on the shaft of the cylinder of the sheet-processing machine and on a shaft of one of the deflection rollers drivingly connected to the motor, the computer and control device having a memory device assigned thereto wherein at least one velocity profile for triggering the motor is stored.

In accordance with an added feature of the invention, the one velocity profile stored in the memory device is of such form that the conveying velocity of the conveyor belt is minimal when a sheet is located in vicinity of the front stops.

In accordance with an additional feature of the invention, the sheet-conveying device includes a timed feed roller engageable with the sheet or shingled sheet stream, the one velocity profile having a further minimum at an angular setting of the sheet-processing machine at which the feed roller engages the sheet or the shingled sheet stream.

In accordance with yet another feature of the invention, the one velocity profile is formed with a plateau in respective minimum and maximum regions thereof.

In accordance with yet a further feature of the invention, the sheet-conveying device includes means for varying the conveying velocity of the conveyor belt in accordance with the velocity of the sheet-processing machine.

In accordance with yet an added feature of the invention, the conveyor table has a given length, and the shingled sheet stream has a mean overlap length which is an integral divisor of the conveyor table length.

In accordance with yet an additional feature of the invention, the one velocity profile has only one minimum and one maximum location.

In accordance with another feature of the invention, the sheet-conveying device includes an input device connected to the computer and control device for adjusting the course of the one velocity profile.

In accordance with a further feature of the invention, the input device is adapted to select the one velocity profile in accordance with the quality of the material of the sheets.

In accordance with an added feature of the invention, the sheet-conveying device includes means for producing a positive and negative offset, respectively, of the one velocity profile in accordance with sheet arrival time.

In accordance with a concomitant aspect of the invention, there is provided a method of conveying sheets in a feeder region of a sheet-processing machine wherein the speed of an electric motor for driving a conveyor belt for conveying single sheets or a shingled sheet stream in the feeder region of a sheet-processing machine by means of a conveying table is controlled with a computer and control device, and wherein the conveyor belt conveys the sheets in a region between a sheet pile and front stops, wherefrom the sheets are transferred to a further processing location of the sheet-processing machine, which comprises feeding a velocity-dependent signal from the sheet-processing machine to the computer and control device; superimposing a further signal stored in a memory and having one minimum and one maximum on the velocity-dependent signal per machine cycle; and overall increasing and reducing, respectively, the conveyor belt velocity as a result of a sheet arrival signal.

Thus, in an advantageous feature of the sheet-conveying device according to the invention, the motor, with a rotary angle encoder, is assigned to one of the deflection rollers of the conveyor belt. Moreover, a rotary angle encoder is provided on a shaft of the cylinder of the sheet-processing machine; advantageously, a memory device in which at least one velocity profile for triggering the motor is stored is assigned to the computer/control device.

In a further advantageous feature of the sheet-conveying device according to the invention, the velocity profile is so formed that the conveying velocity of the conveyor belt is minimal when a sheet is located in the region of the front stops of the conveying table. Because of the reduced velocity and hence the reduced kinetic energy of the sheet arriving at the front stops, damage to the leading edges of the sheets is largely averted, and an improvement in the lay register is attained.

In yet another advantageous feature of the sheet-conveying device according to the invention, the velocity profile, which varies periodically with the machine cycle, has a further minimum at the angular position of the sheet-processing machine at which a timed feed roller, which is disposed directly downstream of the feeder pile, sets down on the individual sheet or the shingled sheet stream. This feed roller has the task of holding down the sheet on the conveying table and transporting it onto the conveyor belt and belts of the conveyor table, respectively. This feature of the device according to the invention offers the advantage that the advancement which the sheet experiences when the feed roller is set down thereon can be adapted or adjusted optimally to the conveying velocity of the pull sucker. In particular, due to the minimum velocity when the feed roller is set down, possible errors which may have arisen in the paper path upstream of the conveyor table are kept within acceptable limits.

Another advantageous feature of the sheet-conveying device according to the invention is that the velocity profile has plateaus both in the region of the minimums and in the region of the maximums. This is especially true for the velocity of a sheet has in the region of the front lay marks.

Further proposed in accordance with the invention is that the velocity profiles be dependent not only on the angular position of the sheet-processing machine but also, when that machine is a printing press, on the printing velocity at which the printing press operates. The profiles are selected so that the lower velocity is always the same. This means that, regardless of the respective printing velocity, the sheets arrive at the front lay marks at the same velocity. Because of the advantageous feature that the sheets, regardless of the respective velocity of the sheet-processing machine, have the same velocity upon arrival at the front lay marks, a considerable simplification is attained in terms of the adjustment of the feeder. As a direct consequence of the occurrence of a lower velocity limit, the profiles stored in memory exhibit a dependency, in terms of the velocity difference, on the velocity of the sheet-processing machine.

In a second exemplary embodiment of the sheet-conveying device according to the invention, additional sensors provided for detecting the leading edge of the sheet transmit signals representing an "early or late sheet" detection to the computer/control device, whereupon an increase and decrease, respectively, in the velocity of the conveyor belt is effected, depending upon the extent of failed arrival, by subjecting the desired velocity course (velocity profile) to a so-called "positive or negative offset".

To achieve an harmonious sheet feeding, it is also proposed, in accordance with the invention, that the velocity profile of the conveyor belt be selected so that, during one machine cycle, only one velocity minimum and one velocity maximum occur.

Other features which are considered as characteristic for the invention are set forth in the appended claims.

Although the invention is illustrated and described herein as embodied in a device for conveying sheets in the feeder region of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
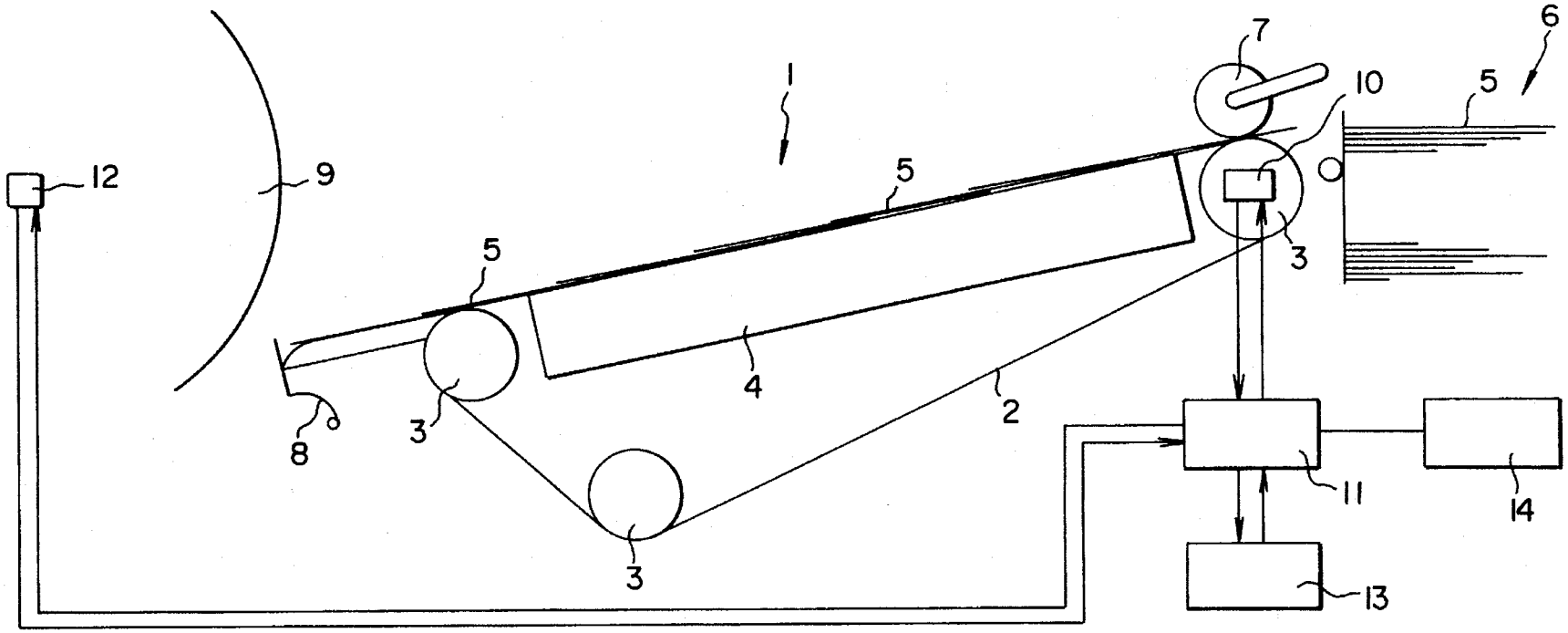
FIG. 1 is a diagrammatic and schematic side elevational view of a feeder of a printing press provided with the device for conveying sheets in the region thereof in accordance with the invention.

Referring now to the drawings and, first, particularly to FIG. 1 thereof, there is diagrammatically and schematically shown therein a feeder of an otherwise non-illustrated sheet-processing machine in the form of a printing press. Sheets 5 are taken from a sheet pile 6 by a non-illustrated conventional suction head, and transported to a conveyor table 1. Sheet transport in the region of the conveyor table 1 is either in single sheets or in shingled sheet streams. When a sheet 5 arrives at the conveyor table 1, a cycled or timed feeder roller 7 sets down on the sheet and pushes it in a direction towards a conveyor belt 2. In particular, the timed feeder roller 7 also serves to hold the leading edge of the sheet on the sheet conveyor table 1 until a suction box 4, which is disposed below the conveying plane, assumes this task. By means of the conveyor belt 2, which is guided over deflection rollers 3, the sheet 5 is transported to front stops 8 of the conveyor table 1. The sheet briefly comes to rest at these front stops 8, and can then be transferred in-register to the printing press, which is represented by only one cylinder 9 thereof.

A motor 10 is assigned to one of the deflection rollers 3. According to the invention, this motor 10 is triggered via a velocity profile especially formed and optimally adapted to existing conditions in accordance with the printing-press operating cycle. This velocity profile is made available to the motor 10 with the inclusion of the signals of an angle encoder 12 by a computing and control device 11. To the computing and control device 11, there is also assigned a memory device 13, in which the velocity profiles are stored both as a function of the angular position, as well as of the respective printing velocity.

Figure 2:
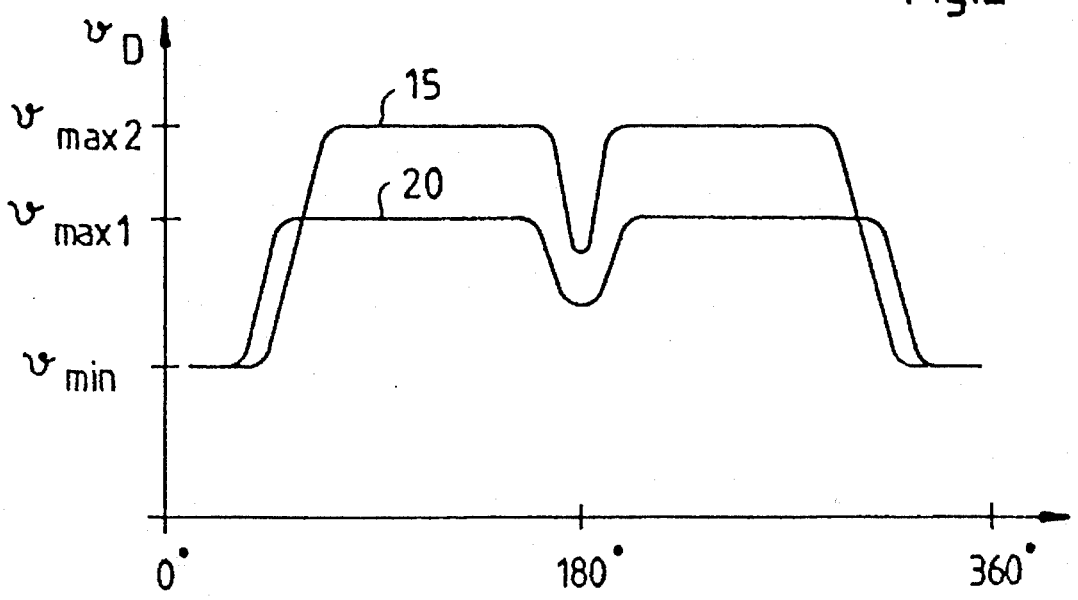
FIG. 2 is a plot diagram showing velocity profiles with which a motor for a conveyor belt of a conveying table of the sheet feeder of FIG. 1 is triggered.

FIG. 2 shows different velocity profiles 15 and 20 with which the motor 10 is triggered to drive the conveyor belt 2. In particular, this FIG. 2 shows velocity profiles for both maximum velocities $v_{max1}$ and $v_{max2}$ over the course of one machine revolution. Both velocity profiles start at the same minimum velocity. This type of configuration offers the advantage that the setting of the feeder for all printing velocities is made uniform and thereby simplified. Choosing the "maximum printing velocity" variable as a parameter in the velocity profiles affords the advantage that the separate drive for the conveyor table 1 can be adapted optimally to the maximum operating velocity of the sheet-processing printing press.

The velocity profiles shown in FIG. 2 have a characteristic shape: In the vicinity of the front lays 8 of the illustrated embodiment of FIG. 1, i.e., the region around 0° or 360° in FIG. 2, the curves show a constant value, a so-called plateau. The curves also have a plateau in the region of the maximum velocity. This formation has a positive effect upon the synchronism of the feeder because, within certain given angular ranges, constant velocities of the conveyor belt are expected. In a region around the 180° angular position of the printing press, the drive of the conveyor belt 2 exhibits a further minimum which, however, does not reach the minimum velocity of the conveyor belt 2. That minimum occurs in a region in which the feed roller 7 is set onto the sheet 5 and the sheet stream, respectively. The reduction in the velocity of the conveyor belt 2 in this region is selected precisely so that negative effects of the timed feed roller 7 on sheet advancement will be virtually entirely compensated for.

Without major problems, the device according to the invention is also suitable for compensating for errors in adjustment of the velocity of the conveyor belts 2, by means of suitably modified velocity profiles in the drive of the conveyor belt 2. For that purpose, the pressman is given the opportunity, via a device 14, of making a corrective change in the particular velocity profile being used.

Figure 3:
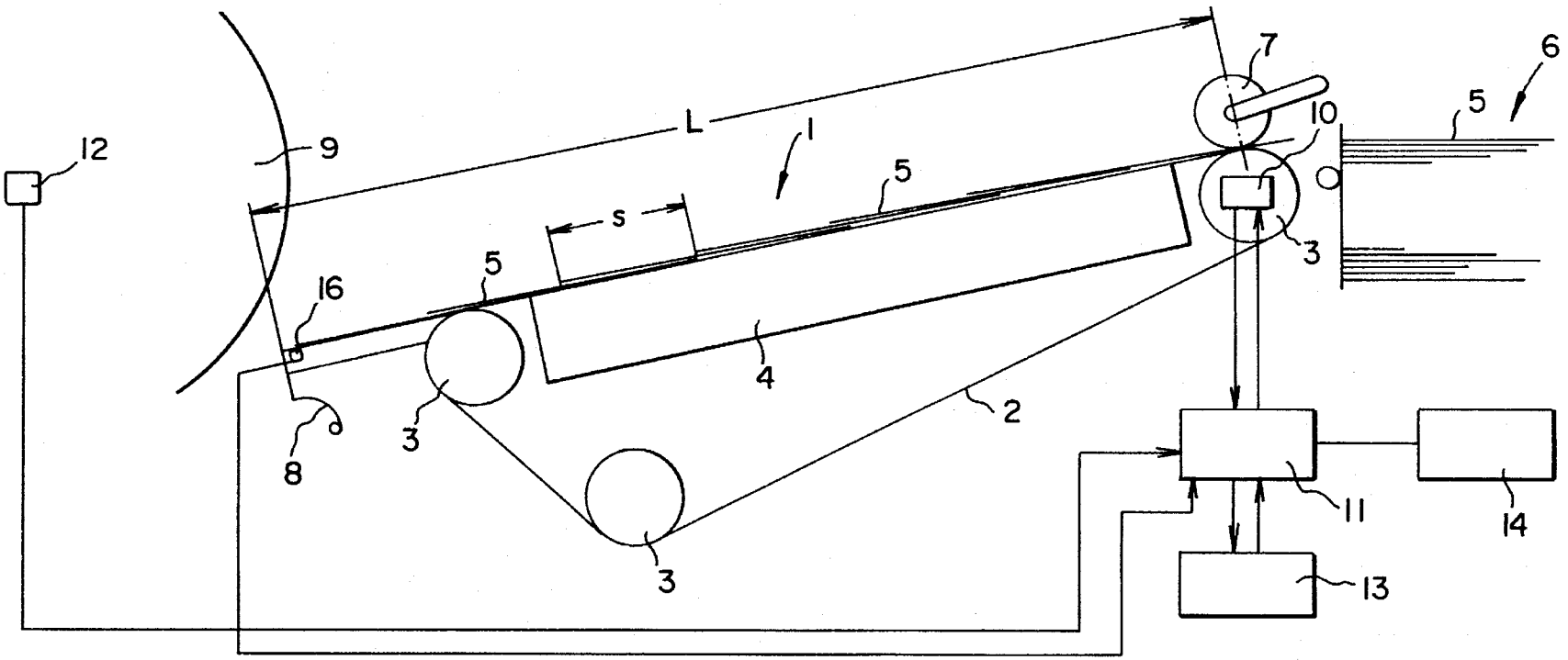
FIG. 3 is a view like that of FIG. 1 of the feeder of a printing press provided with another exemplary embodiment of the device according to the invention.

In an advantageous further feature of the device according to the invention, as shown in another embodiment thereof in FIG. 3, sensors 16 are provided for detecting so-called "out-of-square or misaligned, late or early sheets". The sensors 16 are disposed in the front region of the conveyor table 1, in the vicinity of the front stops 8, and are connected to the computing and control device 11 by suitable conducting elements (electric lines or leads).

Figure 4:
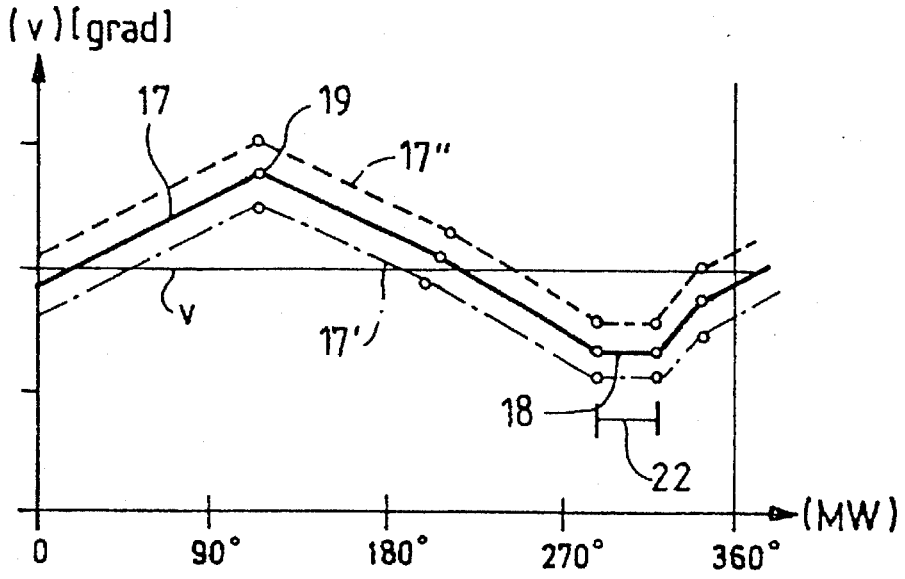
FIGS. 4 and 5 are respective plot diagrams showing velocity profiles with which the motor for the conveyor belt of the conveyor table of the sheet feeder of FIG. 3 is triggered.

FIG. 4 represents a further development of velocity profiles in the field of industrial process technology, which simultaneously takes into account both early and late sheets.

The mean velocity v of the conveyor belt 2 is so modulated in velocity profile 17 during one revolution (360°) of the sheet-processing machine that only one velocity minimum 18 is present. This velocity minimum is advantageously shifted into the region of sheet arrival at the front stop 8 of the sheet-processing machine and is kept constant over an angular range 22, which corresponds to the inaccuracy of sheet arrival. Consequently, within the limits of permissible sheet arrival inaccuracy, all the sheets have the same low sheet arrival velocity and, as a result thereof, an exact alignment of the sheet 5 can be assured prior to the transfer of the sheet to the sheet-processing machine. A velocity maximum 19 is preferably located in a region in which there are no feeder events critical to the paper path, preferably approximately 180° away from the velocity minimum 18, so that the necessary accelerations can still be maintained. Referring to FIG. 3, by defining the overlap length s of the successively transported sheets 5 as an integral divisor n of the conveying table length L, so that $n \times s = L$ (where n=1, 2, 3, . . . ), the preferred conveying state is obtained, wherein a sheet 5 to be fed to the front stops 8 is slowed down precisely in the region minimum velocity represented in the characteristic curve 17 when a trailing sheet 5, which is offset in accordance with the number of overlaps s on the conveyor table 1, is transported by means of the feed roller 7 onto the conveyor table 1. Accordingly, during the operation of the sheet-processing printing press, both the overlap or stagger length s and, with reference thereto, the course of the velocity profile 17 can be varied.

A further modification, i.e., shift, in the velocity profile 17 takes place within the context of sheet arrival regulation or control: Upon a detection of early and late sheets, respectively, by the sensors 16, the velocity profile 17, i.e., the characteristic curve of the mean velocity course of the conveyor belt 2, is lowered and raised, respectively, by means of the computer and control device 11, by a value corresponding to the amount of failed arrival of the sheet 5. If an early sheet is detected, a "negative offset" results, which is a parallel shift of the velocity profile 17 downwardly. If a late sheet is detected, a "positive offset" results, which is a parallel shift of the velocity profile 17 upwardly. The raising and lowering of the velocity profile as a function of the sheet arrival measured by the sensors 6 leads to an overlap or stagger length which varies continuously during operation of the sheet-processing machine. Accordingly, the location of the velocity minimum 18 relative to the sheet arrival at the front stops 8 and relative to the paper transfer to the conveyor table 1 by the feed roller 7 is advantageously not shifted, and constant transfer conditions are thereby achieved.

In an advantageous further development of the method according to the invention, it is proposed that the velocity profiles are so formed as to be a function of the material to be imprinted.

Figure 5:
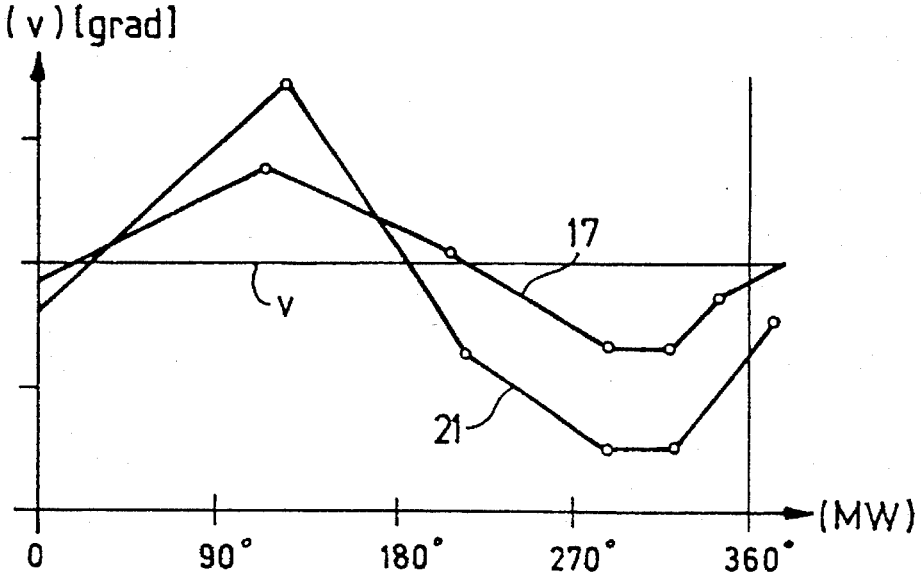

FIG. 5 shows not only the contemplated velocity profile 17, which in essence corresponds to a velocity course for cardboard or pasteboard, but also a further velocity profile 21, which by way of example is employed with thin paper, such as onionskin paper. Onionskin paper, because of its very low inertia, has a favorable or, in other words, reduced tendency to slip relative to the conveyor belt 2, so that with onionskin paper, greater accelerations of the conveyor belt 2 can be performed and, accordingly, lower velocity minimums can be achieved, which in turn lead to reduced paper deformations at the moment the sheet arrives at the front stops 8.

Conversion from one velocity profile 17 to another, for example to the velocity profile 21, is effected by means of the input device 14. Naturally, measuring instruments for measuring the sheet thickness, and so forth, may also be provided, which transmit the measurement values directly to the computer and control device 11, so that an automatic conversion is also possible. In this regard, (standard) velocity profiles stored in the memory device are called up by the control or regulating device as a function of the material being imprinted in order to regulate the motor 10.

The velocity profiles, adapted individually to the quality, thickness and size of material being printed on, differ in number and location from freely selectable velocity specifications for freely selectable angular positions. Thus, even the acceleration conditions can be varied in the individual velocity profile segments. A given final predetermined value, respectively, for the angle and appertaining velocity within a velocity profile, preferably the maximum 19, is selected so that the desired overlap or stagger length s is established, or in other words the area below the velocity profile 19 becomes as large as the area below the mean velocity value.

Depending upon the quality, thickness, size, and so forth, of the material being printed on, individually desirable velocity profiles 17, 21 can be transmitted to the computer and control or regulating device 11 by means of the input device 14. The slopes, zero points and turning points for the desired velocity profile 17, 21 can be selected freely.

In controlling or regulating the velocity of the conveyor belt 2, the computer and control or regulating device 11 provided for controlling the electric motor 10 receives a signal which is a function of the velocity of the sheet-processing machine. A signal stored in the memory device 13, with one minimum 18 and one maximum 19 per machine cycle, is superimposed on the aforementioned signal. In addition, as a consequence of the measured sheet arrival, a signal is generated and fed to the computer and control or regulating device 11, and the overall result thereof is a raising or lowering, respectively, of the conveyor belt velocity.

A suitable input device 14 and memory device 13 are provided in a personal computer such as that of the Digital Equipment Corporation. The computer/control device 11 may be a microcomputer such as that known as Type T805-6255 of the firm INMOS or may also be a personal computer such as that of the aforementioned Digital Equipment Corporation.

We claim:

1. Device for conveying single sheets or a shingled sheet stream in a feeder region of a sheet-processing machine by means of a conveyor table having a given length and being equipped with at least one endless conveyor belt, and at least two rotatably supported deflection rollers over which the conveyor belt is guided, the conveyor belt being disposed so as to convey the sheets in a region between a sheet pile and front stops, wherefrom the sheets are transferable to a further processing location of the sheet-processing machine, comprising a motor for driving the conveyor belt uncoupled from the sheet-processing machine, and a computer and control device for triggering said motor with a predetermined velocity profile exhibiting a velocity change as a function of an angular position of the sheet-processing machine, and wherein the shingled sheet stream has a mean overlap length which is an integral divisor of the given length of the conveyor table and the overlap length is continuously varied based on the course of the predetermined velocity profile.

2. Sheet-conveying device according to claim 1, wherein the sheet-processing machine includes a cylinder having a shaft, a rotary angle encoder mounted on said shaft of said cylinder of the sheet-processing machine and on a shaft of one of said deflection rollers drivingly connected to said motor, said computer and control device having a memory device assigned thereto wherein at least one velocity profile for triggering said motor is stored.

3. Sheet-conveying device according to claim 2, wherein said one velocity profile is formed with a plateau in respective minimum and maximum regions thereof.

4. Sheet-conveying device according to claim 2, wherein said one velocity profile stored in said memory device is of such form that the conveying velocity of the conveyor belt is minimal when a sheet is located in vicinity of the front stops.

5. Sheet-conveying device according to claim 4, including a timed feed roller engageable with the sheet or shingled sheet stream, said one velocity profile having a further minimum at an angular setting of the sheet-processing machine at which said feed roller engages the sheet or the shingled sheet stream.

6. Sheet-conveying device according to claim 2, wherein said one velocity profile has only one minimum and one maximum location.

7. Device for conveying single sheets or a shingled sheet stream in a feeder region of a sheet-processing machine by means of a conveyor table equipped with at least one endless conveyor belt, and at least two rotatably supported deflection rollers over which the conveyor belt is guided, the conveyor belt being disposed so as to convey the sheets in a region between a sheet pile and front stops, wherefrom the sheets are transferable to a further processing location of the sheet-processing machine, comprising a motor for driving the conveyor belt uncoupled from the sheet-processing machine, and a computer and control device for triggering said motor with a predetermined velocity profile exhibiting a velocity change as a function of an angular position of the sheet-processing machine, wherein the sheet-processing machine includes a cylinder having a shaft, a rotary angle encoder mounted on said shaft of said cylinder of the sheet-processing machine and on a shaft of one of said deflection rollers drivingly connected to said motor, said computer and control device having a memory device assigned thereto wherein at least one velocity profile for triggering said motor is stored, and an input device connected to said computer and control device for adjusting a course of said one velocity profile.

8. Sheet-conveying device according to claim 7, wherein said input device is adapted to select said one velocity profile in accordance with a quality of a material of the sheets.

9. Sheet-conveying device according to claim 7, including means for producing a positive and negative offset, respectively, of the one velocity profile in accordance with sheet arrival time.

10. Sheet-conveying device according to claim 1, wherein said motor is assigned to one of said deflection rollers.

11. Sheet-conveying device according to claim 1, including means for varying a conveying velocity of the conveyor belt in accordance with a velocity of the sheet-processing machine.

12. Method of conveying sheets in a feeder region of a sheet-processing machine wherein a speed of an electric motor for driving a conveyor belt for conveying single sheets or a shingled sheet stream in the feeder region of a sheet-processing machine by means of a conveying table is controlled with a computer and control device, and wherein the conveyor belt conveys the sheets in a region between a sheet pile and front stops, wherefrom the sheets are transferred to a further processing location of the sheet-processing machine, which comprises feeding a velocity-dependent signal from the sheet-processing machine to the computer and control device; superimposing a further signal stored in a memory and having one minimum and one maximum on the velocity-dependent signal per machine cycle; and overall increasing and reducing, respectively, the conveyor belt velocity as a result of a sheet arrival signal and an angular position signal of the sheet processing machine.

* * * * *